US005950541A

United States Patent [19]

Nakayama et al.

[11] Patent Number: 5,950,541

[45] Date of Patent: Sep. 14, 1999

[54] METHOD OF PRODUCING LITHOGRAPHIC PRINTING PLATE

[75] Inventors: Takao Nakayama; Atsushi Matsuda, both of Shizuoka, Japan

[73] Assignees: Fuji Photo Film Co., Ltd., Kanagawa; Tomoegawa Paper Co., Ltd., Tokyo, both of Japan

[21] Appl. No.: 09/022,459

[22] Filed: Feb. 12, 1998

[30] Foreign Application Priority Data

Feb. 17, 1997 [JP] Japan ..... 9-048428

[51] Int. Cl.[6] ..... G03G 15/05

[52] U.S. Cl. ..... 101/456; 101/463.1; 430/62

[58] Field of Search ..... 101/456, 463.1; 430/49, 60, 62, 63

[56] References Cited

U.S. PATENT DOCUMENTS

| | | | |
|---|---|---|---|
| 3,639,121 | 2/1972 | York | 430/63 |
| 4,456,670 | 6/1984 | Nakayama et al. | 430/63 |
| 4,555,461 | 11/1985 | Shiba et al. | 430/62 |
| 5,008,167 | 4/1991 | Yu | 430/63 |
| 5,057,389 | 10/1991 | Nakayama et al. | 430/63 |
| 5,382,486 | 1/1995 | Yu et al. | 430/63 |

*Primary Examiner*—Stephen R. Funk

*Attorney, Agent, or Firm*—McAulay Nissen Goldberg Kiel & Hand, LLP

[57] ABSTRACT

A lithographic printing plate is produced using a lithographic printing original plate which is composed of a paper support having a volume electric resistance adjusted to $1\times10^{10}$ Ω·cm or below by undergoing a conductive treatment, a metallic conductive layer provided on one surface of the support, a photoconductive layer composed of zinc oxide and a binder provided on the metallic conductive layer, and a laminate layer composed of an α-polyolefin having a volume electric resistance adjusted to $1\times10^{10}$ Ω·cm or below by undergoing a conductive treatment provided on the other surface of the support. The lithographic printing original plate is subjected to a negative corona discharge from the side having the photoconductive layer and in this charging, a conductor having an earth potential is contacted with the metal conductive layer from the side of the lithographic printing original plate, where an edge of metal conductive layer is exposed. Thereby, the photoconductive layer of the lithographic printing original plate is charged, forming a lithographic printing plate.

1 Claim, 3 Drawing Sheets

METHOD OF PRODUCING LITHOGRAPHIC PRINTING PLATE

FIELD OF THE INVENTION

The present invention relates to a method of producing a lithographic printing plate using an electrophotographic plate-making method. More particularly, it relates to a method of producing a lithographic printing plate which can conduct high speed processing, prevent non-uniform charging, and obtain a high quality toner image having less fog.

BACKGROUND OF THE INVENTION

According to a conventional electrophotographic method, a lithographic printing plate is produced by subjecting a plate for an electrophotographic lithographic printing, which comprises a water-resistant support having formed thereon a layer comprising zinc oxide and a binder, to corona discharge, imagewise exposure, toner development, and fixation, followed by etching treatment.

In general, production of the plate is carried out using a plate-making method in which a voltage is applied to both surfaces of an original plate as shown in FIG. 6. In FIG. 6, exposure light emitted from a light source is condensed by a lens 18. The condensed exposure light forms an image on a master 1' (lithographic printing original plate) which is fed from a feeder 11 with a transport means and has arrived at an exposure section 20 between guide rollers 15 and 16, thereby effecting imagewise exposure to the master 1'. Before the master 1' is transported to the exposure section 20, the master 1' is negatively charged on an upper surface of a photoconductive layer 5 by a negative corona discharge means 12 and also positively charged on a lower surface of the photoconductive layer 5 by a positive corona discharge means 19. Upon imagewise exposure at the exposure section 20, charges on an exposed area disappear by conduction through the photoconductive layer, and charges remain on an unexposed area alone to form an electrostatic latent image. The exposed master 1' is transported to a development-fixation section 17 by a transport means, and therein the electrostatic latent image is developed by adhering toner to the unexposed area and then fixed. Thereafter, the master is subjected to an oil-desensitizing treatment, and then dried to produce a lithographic printing plate.

In the above production method, however, a charging time is required for migration of charges through a support, and thereby a transport speed is controlled and non-uniform charging causes, making it difficult to form a uniform image.

Examples of the water-resistant support which can be used are a paper having been subjected to water-resistant treatment, a metal foil or a composite thereof. In general, the electrophotographic method requires some discharge treatment of a plate in conducting corona charging of a photosensitive layer. Where plate-making is conducted by the method as shown in FIG. 6, charging is achieved by bringing the whole support to have conductivity and also conducting positive corona discharge to the support from the back surface thereof.

When the support used is a paper, conductivity is imparted to the paper by coating it with a solution containing the so-called conductive agent, such as an inorganic electrolyte, e.g., sodium chloride, potassium chloride or calcium chloride, an organic high molecular electrolyte, e.g., a quaternary ammonium salt, or by immersing it in a solution containing such a conductive agent. In this case, the paper can acquire a volume electric resistance of about $1\times10^9$ Ω·cm.

When the thus treated paper is used as a substrate for a lithographic printing original plate, it is unavoidable, even when the paper has been subjected to water resistant treatment, that a dampening water applied to the printing plate during printing causes partial elongation of the paper on rollers used in printing, namely a plate elongation. As a result, various problems may occur during printing, such as wrinkles forming on the back edge or register changes caused by slipping of the printing plate.

With the intention of protecting a paper support from the influence of water, there have been attempts to coat one surface or both surfaces of a paper support with a conductive filler-containing water-resistant epoxy resin, ethylene-acrylic acid-copolymer, or the like, as described in, e.g., JP-A-50-138904, JP-A-55-105580 and JP-A-59-68753 (The term "JP-A" as used herein means an "unexamined published Japanese patent application"), or attempts to use a conductive resin-laminated paper, such as a paper provided with a conductive filler-containing polyethylene laminate, described in, e.g., JP-A-58-57994 and JP-A-59-64395. In these cases, the paper used is also rendered conductive.

An example of the structure of a lithographic printing plate using such a laminate paper is shown in FIG. 7. The lithographic printing plate 1' shown in FIG. 7 is constituted of a support 2 which is prepared by subjecting a paper to a conductive treatment, conductive layers (laminate layers) 3*a* and 3*b* provided respectively on the back and front surfaces of the support, and a photoconductive layer 5 provided on the conductive layer 3*b*. On the photoconductive layer 5, a toner image 6 is formed.

This conductive resin-laminated paper has a structure that a resin film is provided on one surface or both surfaces of a paper, and the resin film is required to contain a conductive filler. Accordingly, the production cost of such a support is high, and it causes a rise in cost of the lithographic printing plate. Where a paper support is coated with a filler-dispersed resin so as to bring the support to have water resistance, it is unsuccessful to ensure satisfactory physical properties in the coating of resin. Thus, it was difficult to achieve high water resistance and high conductivity at the same time.

In addition, there have been attempts to use a paper to which a metal foil, such as an aluminum, zinc or copper foil, is adhered (hereinafter referred to as "a metal foil-laminated paper") as described in, e.g., JP-B-38-17249, JP-B-41-2426 and JP-B-41-12432 (The term "JP-B" as used herein means an "examined published Japanese patent publication"). In these attempts, the paper to be laminated with a metal foil is also a paper soaked with the above-described conductive agent. The use of such a metal foil-laminated paper can produce improvements in elongation at wetting and tensile strength, so that it can ensure high dimensional stability in the printing original plate. As for such a metal foil-laminated paper, it has been attempted to arrange a metal foil on the back surface, on both surfaces or in the center of the paper. In any of such cases, a lithographic printing original plate having excellent dimensional stability can be obtained. However, in any case, a metal foil must be adhered to one or both surfaces of a paper, resulting in increasing production cost of the support as compared with the laminate paper.

SUMMARY OF THE INVENTION

Accordingly, an object of the present invention is to provide a method of producing a lithographic printing plate which is relatively inexpensive, prevents the plate elongation, achieves high-speed processing, and can obtain uniform images.

The above-described object is attained with a method of producing a lithographic printing plate, which comprises the steps of:

using a lithographic printing original plate which comprises a paper support having a volume electric resistance adjusted to $1\times10^{10}$ Ω·cm or below by undergoing a conductive treatment, a metallic conductive layer provided on one surface of the support, a photoconductive layer comprising a zinc oxide and a binder, provided on the metallic conductive layer, and a laminate layer comprising an α-polyolefin having a volume electric resistance adjusted to $1\times10^{10}$ Ω·cm or below by undergoing a conductive treatment, provided on the other surface of the support, subjecting the lithographic printing original plate to negative corona discharge from the side of the photoconductive layer thereof, and in this charging, contacting a conductor having an earth potential with the metallic conductive layer from the side part of the lithographic printing original plate, thereby charging the photoconductive layer of the lithographic printing original plate.

DETAILED DESCRIPTION OF THE INVENTION

Figure 1:
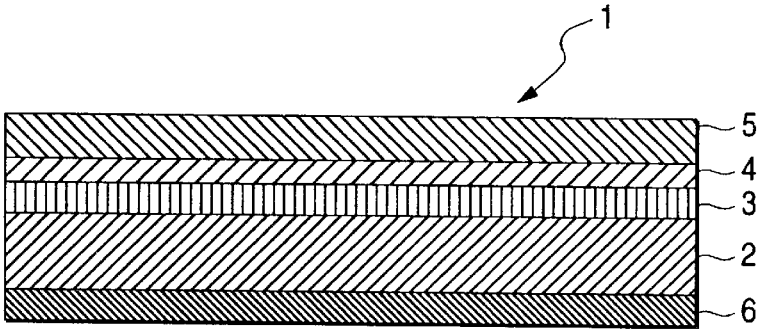
FIG. 1 is a cross sectional view showing the structure of a lithographic printing plate according to the present invention.

The lithographic printing original plate which can be used in the present invention comprises a paper support having a volume electric resistance adjusted to $1\times10^{10}$ Ω·cm or below by undergoing a conductive treatment, a metallic conductive layer provided on one surface of the support, a photoconductive layer comprising zinc oxide and a binder, provided on the metallic conductive layer, and a laminate layer comprising an α-polyolefin having a volume electric resistance adjusted to $1\times10^{10}$ Ω·cm or below by undergoing a conductive treatment, provided on the other surface of the support. The metallic conductive layer provided between the support and the photoconductive layer makes it possible to conduct rapid charging by contacting with a conductor from the side part of the support.

Examples of a paper used as a support includes conductive original papers conventionally used for electrophotographic photosensitive materials, such as papers impregnated with a conductive substance described hereinbelow, papers into which a conductive substance described hereinbelow is blended in paper-making, and synthetic papers described in JP-B-52-4239, JP-B-53-19031 and JP-B-53-19684. It is preferable for such a paper to have a basis weight of 50 to 200 g/m$^2$ and a thickness of 50 to 200 μ.

Examples of the conductive substance with which a paper can be soaked include solutions containing inorganic electrolytes, such as sodium chloride, potassium chloride and calcium chloride, and solutions containing organic high molecular weight electrolytes, such as quaternary ammonium salts. Examples of the conductive substance which can be blended into a paper in paper-making include oxides of metals, such as zinc, magnesium, tin, barium, indium, molybdenum, aluminum, titanium and silicon, and carbon black. It is preferable for the support to have a volume electric resistance of $1\times10^{10}$ Ω·cm or below, preferably $1\times10^{8}$ Ω·cm or below, and more preferably $1\times10^{6}$ Ω·cm or below, with the lower limit being generally $1\times10^{4}$ Ω·cm. By controlling the support so as to have such a volume electric resistance, conduction of charges can be secured.

The metallic conductive layer provided on the support has no particular limitation. Any of simple substances and compounds of metals, such as iron, copper, aluminum, lead and zinc, can be used. Of those, aluminum is especially preferred as a material to be laminated on a paper, because it can be easily formed into a foil due to its low specific gravity and high spreadability. It is preferable for the metallic conductive layer to have a volume electric resistance of $1\times10^{5}$ Ω·cm or below. The thickness of the metallic conductive layer is preferably from 5 to 50 μm, and more preferably from 10 to 25 μm. Such a metallic conductive layer has a low volume electric resistance, so that it enables the photoconductive layer to be rapidly and uniformly charged.

The metallic conductive layer can be provided on a support using a conventional means. For instance, a method of applying an adhesive can be used. Examples of such an adhesive include vinyl acetate resins, acrylic resins, polyolefin resins, urethane resins and phenol resins. These resins are used alone or in the form of mixture or copolymer depending on the end-use purpose. In general, the adhesive is emulsified in water to make a water-based paint or dissolved in an appropriate solvent to make a solvent-based paint, and applied to a metal or paper. With the thus applied adhesive, the metallic conductive layer and the support are adhered together. Water-soluble resins, such as casein and starch, may also be used as an adhesive. Besides the methods of using those adhesives, a hot melt method using a wax resin or a polyolefin resin and an extrusion coating method can be used. It is preferable for the adhesives used to have conductivity. Further, a method of depositing or sputtering a metal onto a support may be used.

It is preferable to provide a blocking layer between the metallic conductive layer and the photoconductive layer. This blocking layer acts to block the transfer of charges or/and electrons, and therefore has effects to increase a charging efficiency and to inhibit non-uniform charging. Examples of a resin which can be used for such a blocking layer include polyamide, polyolefin, ethyl acrylate-ethyl methacrylate copolymer, acrylonitrile-methyl methacrylate copolymer, amylose acetate, styrene-butadiene copolymer, polycarbonate, polyvinyl formate, poly-p-chlorostyrene, polyvinyl acetate, polydimethylsiloxane, polystyrene, polyethylacrylate, polyacrylonitrile, polyacenaphthylene, 1,4-polyisoprene, poly-p-isopropylstyrene, polyethylene terephthalate, polyethylene naphthalate, polyethylene, polyvinyl chloride, polyoxymethylene, polypropylene oxide, polyisobutyl methacrylate, polyethyl methacrylate, poly-2-ethylbutyl methacrylate, poly-n-butyl methacrylate, polymethyl methacrylate, poly-n-lauryl methacrylate, poly-α-methylstyrene, poly-p-methylstyrene, poly-o-methoxystyrene, poly-p-methoxystyrene, polystyrene, polytetrahydrofuran, polyvinyl alcohol, poly-N-vinylcarbazole, poly-1-vinylnaphthalene, poly-2-vinylnaphthalene, polyvinylbiphenyl, poly-2-vinylpyridine, polyphenylene oxide, polybutadiene, polybutene, polybutene oxide, polypropylene, and their copolymers. From these resins, a suitable resin for the blocking layer can be selected. For instance, polymethyl methacryiate and polyacrylonitrile can be selected because of their high ability to form a uniform film. Such a resin is dissolved in an appropriate solvent, and the resulting solution is applied to the metallic conductive layer, and then dried to form a blocking layer.

It is preferable for such a blocking layer to have a volume electric resistance of at least $1\times10^{10}$ Ω·cm, and preferably at least $1\times10^{11}$ Ω·cm. Although it is not particularly limited, the upper limit of the volume electric resistance is generally about $1\times10^{14}$ Ω·cm. The thickness of a blocking layer is generally from 0.2 to 10 μm. As a suitable means to provide a blocking layer on the metallic conductive layer, a conventional coating method can be used. Examples of a coating method which can be used herein include a bar coating method, a roll coating method such as gravure or reverse, a doctor knife coating method, an air knife coating method and a nozzle coating method.

The photoconductive layer used is a layer comprising a binder and zinc oxide (ZnO) dispersed therein.

The grain size of zinc oxide which can be used is generally about 0.1 to 0.5 μm. The photoconductive layer has no particular limitation on the binder used, and any generally used resins having good mechanical and electric properties can be used as the binder. Examples of such a binder include polystyrene, polyacrylic acid esters, polymethacrylic acid esters, polyvinyl acetate, polyvinyl chloride, polyvinyl butyral, derivatives of the polymers described above, polyester resins, acrylic resins, epoxy resins and silicone resins. Of these resins, acrylic resin is preferred. The pigment and such a binder are mixed in a ratio of generally from about 3:1 to about 20:1 by weight. The coating build-up of such a photoconductive layer is generally from 15 to 30 g/m$^2$. The thickness of such a photoconductive layer is preferably from 5 to 30 μm. As a means to provide a photoconductive layer on the metallic conductive layer or the blocking layer, the same methods as adopted in the formation of the conductive layer can be used.

The laminate layer provided on the other surface of the support comprises an α-polyolefin. Examples of such an α-polyolefin include polyethylene, polypropylene and ethylene-butene copolymer. Of those, polyethylene are preferred. It is preferable to use a polyethylene having a density of 0.92 to 0.96 g/cc, a melt index of 1.0 to 30 g/10 min, an average molecular weight of 20,000 to 50,000, a softening temperature of 110 to 130° C. and a tensile strength of 130 to 300 Kg/cm$^2$. It is especially preferable to use a mixture of 10 to 90 parts by weight of a low density polyethylene having a density of 0.915 to 0.930 g/cc and a melt index of 1.0 to 30 g/10 min and 90 to 10 parts by weight of a high density polyethylene having a density of 0.940 to 0.970 g/cc and a melt index of 1.0 to 30 g/10 min. Such a mixture has heat resistance, can provide a uniform laminate layer, and enables the conductive substance to disperse therein in a state that the electric current easily flows through the conductive substance.

Into such an α-polyolefin containing laminate layer, a conductive substance is incorporated so as to provide the laminate layer having a volume electric resistance of $1\times10^{10}$ Ω·cm or below, preferably $1\times10^{8}$ Ω·cm or below, more preferably $1\times10^{6}$ Ω·cm or below, with lower limit being generally $1\times10^{2}$ Ω·cm. Examples of a conductive substance which can be used include the same substances as ones blended into the paper support. When the laminate layer is too thin, the strength and water resistance thereof are insufficient. On the other hand, when it is too thick, improvements in performances cannot be expected. Accordingly, the thickness of the laminate layer is generally about 5 to 50 μm, and preferably about 10 to 30 μm.

For the purpose of elevating the adhesion force between the laminate layer and the support, it is preferable to previously coat the support surface with a polyethylene derivative, such as an ethylene-vinyl acetate copolymer, an ethylene-acrylate copolymer, an ethylene-methacrylate copolymer, an ethylene-acrylic acid copolymer, an ethylene-methacrylic acid copolymer, an ethylene-acrylonitrile-acrylic acid terpolymer and an ethylene-acrylonitrile-methacrylic acid terpolymer, or to previously subject the support surface to a corona discharge treatment. Also, the support can undergo the surface treatment as described in, e.g., JP-A-49-24126, JP-A-52-36176, JP-A-52-121683, JP-A-53-2612, JP-A-54-111331 and JP-B-51-25337.

Further, a backing layer may be provided on the α-polyplefin containing laminate layer. To this backing layer are given antislip properties and, if desired, a function as a conductive layer. Thus, the backing layer has a constitution that the conductive agent and particles for controlling the rigidness (particle size: about 0.1 to 1 μm) are homogeneously dispersed in a polymer binder.

Examples of a polymer binder used in the backing layer include polyethylene, polybutadiene, polyacrylate, polymethacrylate, polyamylose acetate, nylon, polycarbonate, polyvinyl formate, polyvinyl acetate, polyacenaphthylene, polyisoprene, polyethylene terephthalate, polyvinyl chloride, polyoxyethylene, polypropylene oxide, polytetrahydrofuran, polyvinyl alcohol, polyphenylene oxide, polypropylene, their copolymers, hardened gelatin, and hardened polyvinyl alcohol.

The constitutive example of a lithographic printing plate according to the present invention is described below by reference to the accompanying drawings.

An example of the constitution of the lithographic printing plate of the present invention is schematically shown in FIG. 1. As shown in FIG. 1, the lithographic printing original plate (master) has, on one surface of a paper support 2, a metallic conductive layer 3, a blocking layer 4 and a photoconductive layer 5, which are arranged in that order, and on the other surface of the paper support, a laminate layer 6. The photoconductive layer 5 charged by a prescribed operation is exposed to light, forms a toner image thereon by development, and is further oil-desensitized (etched) to provide a lithographic printing plate.

Figure 2:
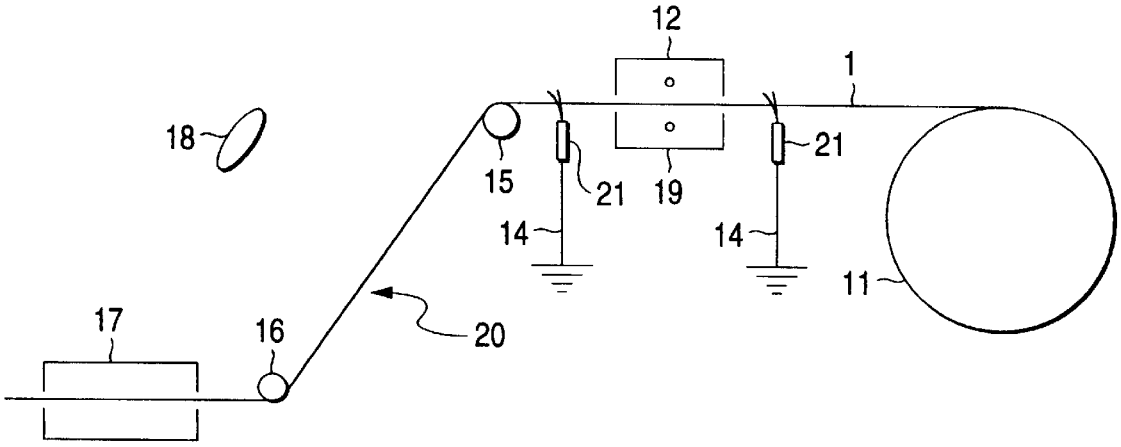
FIG. 2 is a schematic view showing a process (apparatus) for producing a lithographic printing plate in accordance with the present invention.

The method of producing a lithographic printing plate in accordance with the present invention is explained below. FIG. 2 is a schematic view showing a process (apparatus) of producing a lithographic printing plate in accordance with the present invention. As shown in FIG. 2, the master 1 is fed from a feeder 11 with a transport means, and arrives at the charging section. In this section, the photoconductive layer 5 is negatively charged by a negative charging means 12 on the upper side thereof and positively charged by a positive charging means 19 on the lower side thereof. In front and/or back of the charging means 12 and 19, a conductor 21 is arranged. The conductor is brought into contact with the side part of the master, and as a result, the metallic conductive layer 3 comes into contact with the conductor. The conductor is grounded by an earthing conductor 14, and functions as an earthing electrode when it is brought into contact with the metallic conductive layer 3. Accordingly, it is also possible to use the negative corona discharge means 12 alone. In the thus constituted charging section, it becomes possible to get rid of non-uniform charging and to shorten the charge saturation time. Thus, the processing speed can be increased. The conductor 21 can be made of a fibrous or rod-like metallic material having a volume electric resistance of $1\times10^3$ Ω·cm or below, such as fibrous or rod-like iron, copper, aluminum and stainless steel which may undergo surface treatment with nickel, chromium or the like, or may be made of carbon fibers or a material prepared by incorporating a conductive substance into a resin and forming the resulting resin into fibers.

Figure 3:
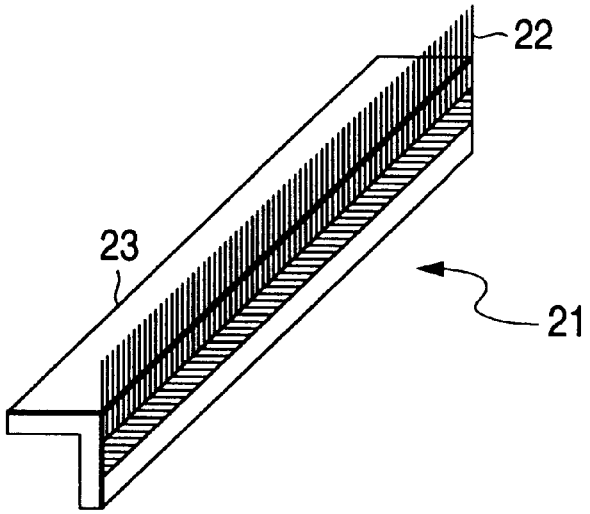
FIG. 3 is an external perspective view showing a representative example of a constitution of a conductor.
Figure 4:
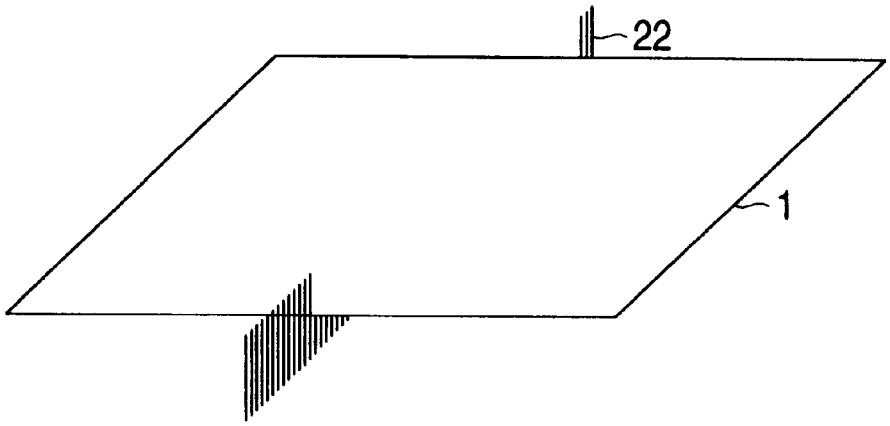
FIG. 4 is a schematic view showing a relationship between a conductor and a master.

More specifically, in the charging step according to the present method, a grounded brush-form or brush-like conductor 21 is arranged in front or/and back of the corona discharge means 12 and 19, and made to approach the master 1 from the side, and thereby comes into direct contact with the metallic conductive layer 3. This conductor 21 may have a structure as shown in FIG. 3, wherein a lot of fibrous or rod-like conductors are arranged so as to stand upright on a metal support 23 to be formed into a brush 22, and this brush may be brought into contact with the side part of the master 1. By arranging such a conductor 21 in front or back of the corona discharge means 12 and 19, as shown in FIG. 4, parts of the brush 22 stand upright on both sides of the master 1 and come into contact with the metallic conductive layer 3 of the master 1 when the master 1 passes across the brush. By constituting the charging section in this way, the charging can be performed more smoothly, restrictions on the thickness of a support 2 can be removed, the transport speed can be increased, and non-uniform charging can be reduced.

Figure 5:
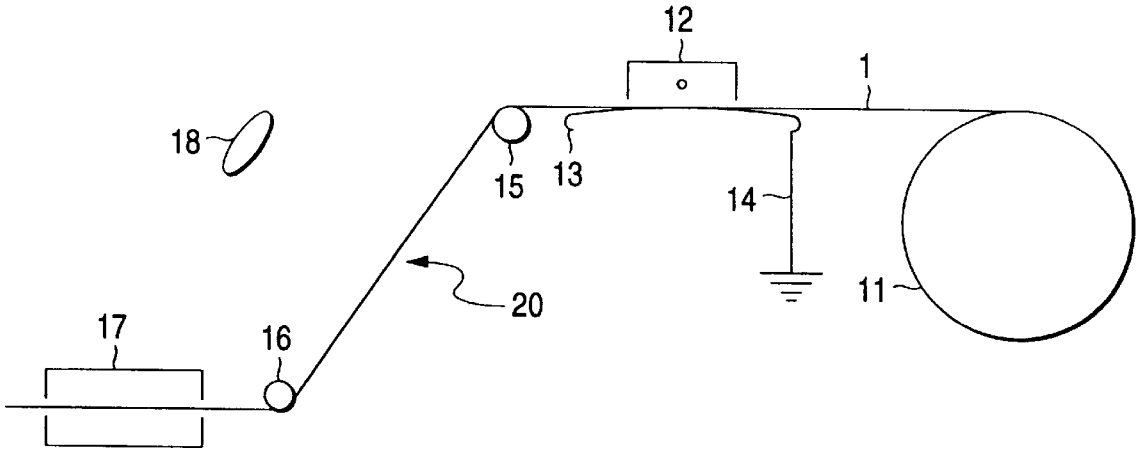
FIG. 5 is a schematic view showing a production process (apparatus), wherein charging is carried out with a negative corona discharge means and a conductor which is grounded.
Figure 6:
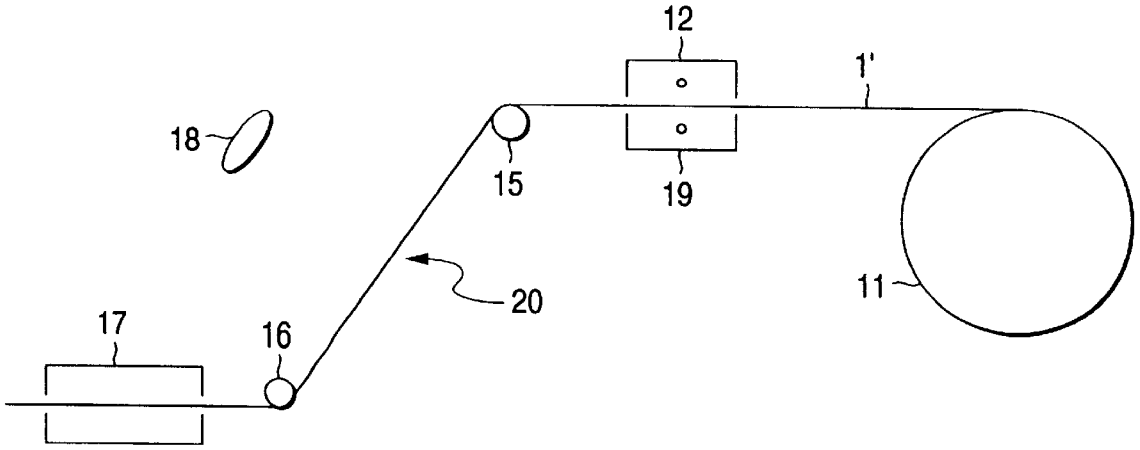
FIG. 6 PRIOR ART
FIG. 6 is a schematic view showing a conventional process (apparatus) for producing a lithographic printing plate.
Figure 7:
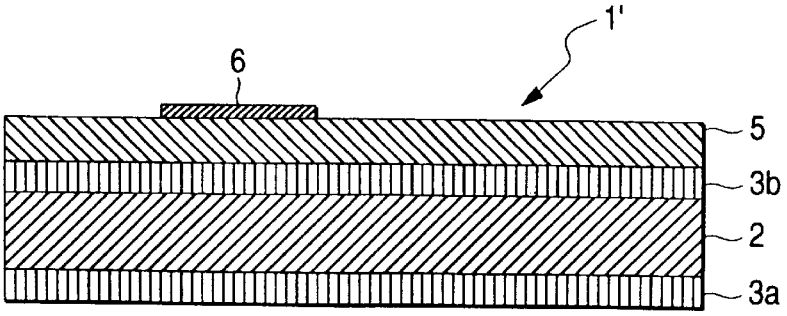
FIG. 7 PRIOR ART
FIG. 7 is a cross sectional view showing the structure of a conventional lithographic printing plate.

In charging the photoconductive layer, it is also effective to use a method of carrying out negative corona discharge on the surface side of the master 1 and, at the same time, bringing the grounded conductor 13 into contact with the back side of the master 1. More specifically, as shown in FIG. 5, the master 1 is fed from a feeder 11, and arrives at the charging section. In this section, the photoconductive layer 5 is charged negatively on the upper side thereof and positively on the lower side thereof by a negative corona discharge means 12 arranged on the upper side thereof and a conductor 13 which is grounded by an earthing conductor 14 to have earth potential. The conductor 13 is brought into contact with the laminate layer 6 of the master 1, and functions as not only an earthing electrode but also a transport guide. The conductor 13 is preferably made of, e.g., a metal such as iron, copper or aluminum, an alloy such as stainless steel, a metal or alloy which has undergone a surface treatment with nickel, chromium or the like, a carbon resin or a material prepared by incorporating a conductive substance into a resin. The thickness of the conductor can be properly chosen depending on the property of the material used for making it and the structure of a plate-making apparatus used. As a general guide, the thickness is generally 0.1 to 5 mm. In addition, the size thereof may be chosen depending on the size of a corona discharge means (charger) used and the size of the master 1.

In the exposure section 20 situated between two guide rollers 15 and 16, imagewise exposure is carried out using a laser beam, incandescent light or the like focused by a lens 18. Thereby, the charges disappear in the exposed area and remain in the unexposed area alone. The thus exposed master 1 is transported to the development-and-fixation section 17 by a transporting means, developed by attaching toner to the unexposed area, and then subjected to fixation. Further, the thus processed master is subjected to a hydrophilic treatment, and then dried. Thus, an original plate for lithographic printing is produced. The toner used is generally a liquid toner.

Oil-desensitization of zinc oxide can be effected using processing solutions known to be useful for this purpose, such as a processing solution containing as a main component a cyan compound (e.g., ferrocyanide, ferricyanide), a cyan-free processing solution containing as a main component an amine-cobalt complex, phytic acid or a derivative thereof, or a guanidine derivative, a processing solution containing as a main component an inorganic or organic acid capable of forming a chelate together with zinc ion, or a processing solution containing a water-soluble polymer.

Examples of a processing solution containing a cyan compound include those described in, for example, JP-B-44-9045, JP-B-46-39403, JP-A-52-76101, JP-A-57-107889 and JP-A-54-117201.

Examples of a processing solution containing a phytic acid compound include those described in JP-A-53-83807, JP-A-53-83805, JP-A-53-102102, JP-A-53-109701, JP-A-53-127003, JP-A-54-2803 and JP-A-54-44901.

Examples of a processing solution containing a metal complex compound such as a cobalt complex include those described in, for example, JP-A-53-104301, JP-A-53-140103, JP-A-54-18304 and JP-B-43-28404.

Examples of a processing solution containing an inorganic or organic acid include those described in, for example, JP-B-39-13702, JP-B-40-10308, JP-B-43-28408, JP-B-40-26124 and JP-A-51-118501.

Examples of a processing solution containing a guanidine compound include those described in, for example, JP-A-56-111695.

Examples of a processing solution containing a water-soluble polymer include those described in, for example, JP-A-52-126302, JP-A-52-134501, JP-A-53-49506, JP-A-53-59502, JP-A-53-104302, JP-B-38-9665, JP-B-39-22263, JP-B-40-763, JP-B-40-2202 and JP-A-49-36402.

In the oil-desensitization using any of the processing solutions described above, the zinc ion generated by ionization of zinc oxide present in a surface layer undergoes the chelating reaction with a chelating compound contained in the processing solution to form the chelate of zinc ion. It is believed that this chelate is deposited on the surface layer and renders the surface hydrophilic.

The oil-desensitization is generally carried out for about 0.5 to about 30 seconds at room temperature (15° C.–35° C.). When offset printing is performed using the thus processed printing plate and a dampening solution, about 3,000 sheets of print can be obtained.

The present invention will now be described in more detail by reference to the following examples.

EXAMPLE 1

Preparation of Support and Laminate Layer:

A 5% aqueous solution of calcium chloride was applied to wood free paper at a coating build-up of 20 g/m$^2$, and dried to prepare a conductive support having a basis weight of 110 g/m$^2$. On this support, a water-soluble latex of ethylene-methyl acrylate-acrylic acid (65:30:5 by mole) copolymer was coated so as to have a dry coverage of 0.2 g/m$^2$, and dried. On one side of the resulting support, a pellet prepared by melting and kneading a mixture of 70 wt % of a low density polyethylene having a density of 0.920 g/cc and a melt index of 5.0 g/10 min, 15 wt % of a high density polyethylene having a density of 0.950 g/cc and a melt index of 8.0 g/10 min and 15 wt % of carbon black was provided in a thickness of 30 $\mu$m using an extrusion coating method. The support and this coating film were adhered together by means of a laminator. The thus obtained laminate layer had a volume electric resistance of $7.5\times10^6$ Ω·cm.

Preparation of Metallic Conductive Layer and Blocking Layer:

On the side opposite the laminate layer, the support was coated with a thermosetting conductive adhesive. One side of an aluminum foil was coated in advance with an acrylic polymer having a volume electric resistance of $3\times10^{14}$ Ω·cm so as to have a uniform thickness of 2 $\mu$m by means of a wire bar, thereby forming a blocking layer. The uncoated side of this aluminum foil and the adhesive-coated side of the support were brought into contact with each other, and allowed to stand for 24 hours at 80° C., thereby adhering them together. Thus, a metallic conductive layer was formed on the support.

Preparation of Photoconductive Layer:

On the acrylic polymer layer coated on the aluminum foil, a dispersion having the following composition (1) was coated uniformly by means of a wire bar such that the solids coverage was 25 g/m$^2$, dried for 1 minute in the atmosphere of 100° C., and allowed to stand for 24 hours in a dark room regulated at 20° C. and 60% RH, thereby forming a photoconductive layer (Sample 1).

Composition (1):

| | |
|---|---|
| Photoconductive zinc oxide | 100 parts by weight |
| Acrylic resin | 20 parts by weight |
| Toluene | 125 parts by weight |
| Phthalic anhydride | 0.1 parts by weight |
| Rose Bengal (4% methanol soln.) | 4.5 parts by weight |

Preparation of Comparative Sample:

On the both sides of the same paper support as used for Sample 1, the same laminate layer as provided in Sample 1 was provided. The laminate layer provided on one side of the support was subjected to a corona discharge treatment, and provided with the same blocking layer as in Sample 1 without providing with a metallic conductive layer. On this blocking layer, the same photoconductive layer as in Sample 1 was provided, thereby preparing a Comparative Sample.

Plate-making:

Each of the thus prepared samples was made into a printing plate using a plate-making apparatus having the constitution as shown in FIG. 2 (ELP-404 V, made by Fuji Photo Film Co., Ltd.). In this plate-making apparatus ELP-404 V, the conductor 21 as shown in FIG. 3 was arranged in front of chargers 12 and 19 as corona discharge means (the other conductor arranged in back of the chargers was omitted in this case). The voltage applied to the negative charger was adjusted to −6 KV, the voltage applied to the positive charger was adjusted to +6 KV, and the transport speed of each sample was changed from 250 mm/sec to 550 mm/sec at intervals of 50 mm/sec. After 7 seconds from the passage of the rear end of each sample between the chargers, the surface potential of the photoconductive layer, V7, was measured. It is preferable for V7 to be at least 520 V, and more preferably at least 600 V.

Each of the samples charged above was subjected to proper exposure (4.3 sec) in the exposure section, developed and fixed at a usual speed. By the use of the original plate thus obtained, the printing was performed, and the uniformity in the solid area was evaluated. The results obtained are shown in Table 1.

The evaluation of uniformity in the solid area was made using the medium density region of a continuous step wedge stenciled in a reflective original (corresponding to the toner reflection densities between 0.45 and 0.50). When the solid area is uniform, letters and halftone dots which are sharp in shape and free from notches can be obtained. The following is an evaluation criterion:

○: The solid area measuring 15 cm square is uniform throughout.

Δ: In the solid area measuring 15 cm square, faint mark of non-uniform charging is observed.

x: In the solid area measuring 15 cm square, clear mark of non-uniform charging is observed.

TABLE 1

(with conductor)

| Transport | Sample 1 | | Comparative Sample | |
|---|---|---|---|---|
| speed (mm/sec) | V7 (V) | Uniformity | V7 (V) | Uniformity |
| 250 | 663 | ○ | 642 | Δ |
| 300 | 659 | ○ | 647 | Δ |
| 350 | 672 | ○ | 631 | Δ |
| 400 | 670 | ○ | 631 | Δ |
| 450 | 665 | ○ | 493 | Δ |
| 500 | 649 | ○ | 405 | × |
| 550 | 522 | ○ | 297 | × |

As can be seen from Table 1, the master prepared in accordance with the present invention was successful in achieving both satisfactory uniformity and V7 greater than 520 V, in the whole range of transport speed, from 250 mm/sec to 550 mm/sec; while the comparative master failed to provide satisfactory uniformity.

Comparative Example 1

The plate-making was performed in the same manner as in Example 1, except that the conductor was removed from the plate-making apparatus ELP-404 V, and the surface potential and the uniformity in the solid area were evaluated using the same criteria. The results obtained are shown in Table 2.

TABLE 2

(without conductor)

| Transport | Sample 1 | | Comparative Sample | |
|---|---|---|---|---|
| speed (mm/sec) | V7 (V) | Uniformity | V7 (V) | Uniformity |
| 250 | 655 | Δ | 640 | Δ |
| 300 | 659 | Δ | 645 | Δ |
| 350 | 650 | Δ | 658 | Δ |
| 400 | 633 | Δ | 630 | × |
| 450 | 508 | Δ | 520 | × |
| 500 | 445 | × | 431 | × |
| 550 | 321 | × | 303 | × |

As can be seen from Table 2, the master prepared in accordance with the present invention, although successful in achieving desirable V7 at the transport speed ranging from 250 mm/sec to 400 mm/sec, was unsatisfactory with respect to the uniformity which is reflected in the practical properties; while the comparative master also had the same tendency as the present master, and failed to provide satisfactory uniformity.

The printing operations were performed using the master obtained above and a printing machine, Oliver 52, made by Sakurai Graphic Systems Co., Ltd., and it was confirmed that the uniformity of printed images corresponded to uniformity of the images formed on the master. Even after printing 10,000 sheets, no elongation was observed at all in the printing plate according to the present invention.

In accordance with the method of the present invention, a lithographic printing plate which can provide uniform images, has neither elongation nor non-uniform charging mark, and can be handled with ease, is produced at low cost.

While the invention has been described in detail and with reference to specific embodiments thereof, it will be apparent to one skilled in the art that various changes and modifications can be made therein without departing from the spirit and scope thereof.

What is claimed is:

1. A method of producing a lithographic printing plate, which comprises the steps of:

using a lithographic printing original plate which comprises a paper support having a volume electric resistance adjusted to $1\times10^{10}$ Ω·cm or below by undergoing a conductive treatment, a metallic conductive layer provided on one surface of the support, a photoconductive layer comprising a zinc oxide and a binder, provided on the metallic conductive layer, and a laminate layer comprising an α-polyolefin having a volume electric resistance adjusted to $1\times10^{10}$ Ω·cm or below by undergoing a conductive treatment, provided on the other surface of the support, subjecting the lithographic printing original plate to negative corona discharge from the side of the photoconductive layer thereof, and in this charging, contacting a conductor having an earth potential with the metallic conductive layer from a side part of the lithographic printing original plate, thereby charging the photoconductive layer of the lithographic printing original plate.

* * * * *